US006838421B2

(12) United States Patent
Mercado

(10) Patent No.: US 6,838,421 B2
(45) Date of Patent: Jan. 4, 2005

(54) BATHROOM CLEANING COMPOSITION

(75) Inventor: Hedeliza Malonzo Mercado, Scarborough (CA)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/440,963

(22) Filed: May 19, 2003

(65) Prior Publication Data

US 2004/0235698 A1 Nov. 25, 2004

(51) Int. Cl.[7] ..... C11D 3/00; C11D 3/22; C11D 7/18; C11D 77/04

(52) U.S. Cl. ..... 510/238; 510/199; 510/380

(58) Field of Search ..... 510/191, 199, 510/238, 380, 381

(56) References Cited

U.S. PATENT DOCUMENTS 5,064,553 A * 11/1991 Dixit et al. ..... 510/222
5,510,047 A * 4/1996 Gabriel et al. ..... 510/221
6,034,046 A * 3/2000 Blanvalet et al. ..... 510/362
6,140,300 A * 10/2000 Sirianni ..... 510/380

* cited by examiner

*Primary Examiner*—Yogendra N. Gupta
*Assistant Examiner*—John M. Petruncio
(74) *Attorney, Agent, or Firm*—Bernard Lieberman

(57) ABSTRACT

A bathroom cleaning composition containing a chlorine containing bleach, that is effective in removing mold and mildew as well as removing soap scum.

8 Claims, No Drawings

BATHROOM CLEANING COMPOSITION

FIELD OF THE INVENTION

The present invention relates to a bathroom cleaning which remove mold and mildew as well as removing soap scum.

BACKGROUND OF THE INVENTION

Bathroom cleaning consists of removing mold and mildew as well as soap scum. Hypochlorite is the best in killing and removing mold and mildew organisms/stains in damp places such as the bathroom. Unfortunately, the existing hypochlorite containing products have a poor performance in removing soap scum.

Soap scum is mostly the precipitated calcium/magnesium salts of the fatty acid chain present in the soap with some multivalent cations depending on the hardness of the water supply, particulate dirt, lint and some skin cells. Such dirt composition is very difficult to be removed with alkaline products. Hence, historically, dedicated products such as acid base and non-bleach alkaline products containing solvents are used solely for soap scum removal with the drawback of not being able to effectively remove mold and mildew. Consequently, another product, typically with hypochlorite is used in tandem to remove mold and mildew.

Hypochlorite products require high level of alkalinity for stability reason. Couple with the very limited as well as very costly solvent materials that can be compatible with hypochlorite, makes it very challenging to develop a hypochlorite containing product for its mold and mildew performance that can provide superior soap scum removal.

The instant invention discloses a hypochlorite product that provides superior soap scum removal in the laboratory testing and still is effective in removing mold and mildew.

U.S. Pat. No. 5,972,239 teaches an acidic bleaching solution containing a chlorine deactivating agent.

EPA Patent 0,875,552 teaches an acidic limescale removing composition containing an acid.

EPA Patent 0,630,963 teaches an acid microemulsion composition designed to remove soap scum.

SUMMARY OF THE INVENTION

The present invention relates to a bathroom cleaning composition which removes soap scum as well as mold and mildew, wherein the bathroom cleaning composition contains a chlorine containing bleach, a surfactant, a viscosity control agent, a corrosion inhibitor, a sequestrant builder, an agent to reduce bleach odor on skin, a perfume, a foam control agent and water.

An object of the instant invention is to provide a bathroom cleaning composition that removes soap scum as well as mold and mildew.

To achieve the foregoing and other objects in accordance with the purpose of the invention, as embodied and broadly described herein the novel bathroom cleaning composition contains a surfactant, a chlorine containing bleach, at least one viscosity control agent, a corrosion inhibitor, a sequestrant builder, a bleach odor reducing agent, a perfume, a foam control agent and water, wherein the composition does not contain hydrogen peroxide or sodium montmorillonite and the composition has a pH of at least 9.

DETAILED DESCRIPTION OF THE INVENTION

The present invention relates to a bathroom cleaning composition which comprises approximately by weight:

(a) 0.1% to 10%, more preferably 0.5% to 5.0% of a chlorine bleach compound;

(b) 0.5% to 5%, more preferably 2.0% to 4% of an amine oxide surfactant;

(c) 0.05% to 3.0% of an alkali metal hydroxide such as sodium hydroxide or potassium hydroxide;

(d) 0.1% to 3% of an alkali metal silicate which is a corrosion inhibitor;

(e) 0.25% to 5% of a phosphate builder salt which is a sequestration builder salt;

(f) 0 to 1.5%, more preferably 0.1% to 1% of a fatty acid which functions as a viscosity control agent;

(g) 0.0001% to 0.10% of a silicone foam control agent;

(h) 0.01% to 0.6%, more preferably 0.1% to 0.5% of a perfume;

(i) 0 to 0.0010%, more preferably 0.00005% to 0.0006% of a bleach odor reducing agent;

(j) the balance being water, wherein the composition has a pH of about 9 to about 14.

Amine oxide semi-polar nonionic surfactants used in the instant composition comprise compounds and mixtures of compounds having the formula

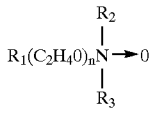

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

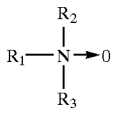

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 which is hereby incorporated herein by reference.

Although any chlorine bleach compound may be employed in the compositions of this invention, such as dichloro-isocyanurate, dichloro-dimethyl hydantoin, or chlorinated TSP, alkali metal or alkaline earth metal, e.g. potassium, lithium, magnesium and especially sodium, hypochlorite is preferred. A solution containing about 0.1% to 10.0% by weight of sodium hypochlorite contains or provides the necessary percentage of available chlorine. About 0.5% to 5% by weight of available chlorine is especially preferred. For example, sodium hypochlorite (NaOCl) solution of from about 11 to about 13% available chlorine in amounts of about 1.0% to 79%, preferably about 4.0 to 40.0%, can be advantageously used.

The preferred long chain fatty acids used in the instant compositions are the higher aliphatic fatty acids having from about 8 to 22 carbon atoms, more preferably from about 10 to 20 carbon atoms, and especially preferably from about 12 to 18 carbon atoms, inclusive of the carbon atom of the carboxyl group of the fatty acid. The aliphatic radical may be saturated or unsaturated and may be straight or branched. Straight chain saturated fatty acids are preferred. Mixtures of fatty acids may be used, such as those derived from natural sources, such as tallow fatty acid, coco fatty acid, soya fatty acid, etc., or from synthetic sources available from industrial manufacturing processes.

Thus, examples of the fatty acids include, for example, decanoic acid, dodecanoic acid, palmitic acid, myristic acid, stearic acid, tallow fatty acid, coco fatty acid, soya fatty acid, mixtures of these acids, etc. Stearic acid and mixed fatty acids, e.g. stearic acid/palmitic acid, are preferred.

When the free acid form of the fatty acid is used directly it will generally associate with the potassium and sodium ions in the aqueous phase to form the corresponding alkali metal fatty acid soap. However, the fatty acid salts may be directly added to the composition as sodium salt or potassium salt, or as a polyvalent metal salt, although the alkali metal salts of the fatty acids are preferred fatty acid salts.

The amount of the fatty acid or fatty acid salt stabilizer to achieve the desired enhancement of physical stability will depend on such factors as the nature of the fatty acid or its salt, the nature and amount of the thickening agent, detergent active compound, inorganic salts, other ingredients, as well as the anticipated storage and shipping conditions.

Alkali metal (e.g. potassium or sodium) silicate, which provides alkalinity and protection of hard surfaces, such as fine china glaze and pattern, is generally employed in an amount ranging from about 0.1 to 3 weight percent, preferably about 0.2 to 2.5 weight percent in the composition. The sodium or potassium silicate is generally added in the form of an aqueous solution, preferably having $Na_2O:SiO_2$ or $K_2O:SiO_2$ ratio of about 1:1.3 to 1:2.8. A preferred silicate is sodium metasilicate.

A preferred solid phosphate builder salt used in the instant composition is an alkali metal polyphosphate such as sodium tripolyphosphate ("TPP"). One suitable TPP is sold under the name Thermphos NW. The particles size of the Thermphos NW TPP, as supplied is usually averages about 200 microns with the largest particles being about 400 microns. In place of all or part of the alkali metal polyphosphate one or more other detergent builder salts can be used. Suitable other builder salts are alkali metal carbonates, phosphates, silicates, lower polycarboxylic acid salts, and polyacrylates, polymaleic anhydrides and copolymers of polyacrylates and polymaleic anhydrides and polyacetal carboxylates.

Specific examples of such builders are sodium carbonate, potassium carbonate, sodium pyrophosphate, sodium tripolyphosphate, potassium tripolyphosphate, potassium pyrophosphate, sodium hexametaphosphate, sodium sesquicarbonate, sodium mono and diorthophosphate. The builder salts can be used alone with the amine oxide nonionic surfactant or in an admixture with other builders.

Essentially, any compatible anti-foaming agent can be used in the instant composition. Preferred anti-foaming agents are silicone anti-foaming agents. These are alkylated polysiloxanes and include polydimethyl siloxanes, polydiethyl siloxanes, polydibutyl siloxanes, phenyl methyl siloxanes, trimethysilanated silica and triethylsilanated silica. A suitable anti-foaming agent is Silicone TP201 or Silicone RD from Union Carbide.

The perfumes that can be used in the instant composition includes any perfume that is compatible with bleach.

The instant compositions can optionally contain a bleach odor reducing agent which is preferably ethyl tricyclo $[5.2.1.0^{25}]$decan-2-carboxylate such as fruitate which is available from the KAO Corporation.

A bleach stabilizer can be optionally used in the instant composition at a concentration of 0.0001 wt. % to 0.1 wt. %. A preferred bleach stabilizer is sodium metaperiodate.

A polymeric thickening agent can be optionally used in the instant composition at a concentration of 0.05 wt. % to 2.5 wt. %. A preferred polymeric thickening agent is crosslinked polyacrylic acid-type thickening agents which are the products sold by B.F. Goodrich under their Carbopol trademark, especially Carbopol 941, which is the most ion-insensitive of this class of polymers, and Carbopol 940 and Carbopol 934. The Carbopol resins, also known as "Carbomer," are hydrophilic high molecular weight, crosslinked acrylic acid polymers having an average equivalent weight of 76, and the general structure illustrated by the following formula:

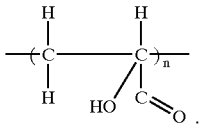

Carbopol 941 has a molecular weight of about 1,250,000; Carbopol 940 a molecular weight of approximately 4,000,000 and Carbopol 934 a molecular weight of approximately 3,000,000. The Carbopol resins are crosslinked with polyalkenyl polyether, e.g. about 1% of a polyalkyl ether of sucrose having an average of about 5,8 alkyl groups for each molecule of sucrose. Further detailed information on the Carbopol resins is available from B.F. Goodrich, see, for example, the B.F. Goodrich catalog GC-67, Carbopol® Water Soluble Resins.

As used herein "polyacrylic acid-type" refers to water-soluble homopolymers of acrylic acid or methacrylic acid or water-dispersible or water-soluble salts, esters or amides thereof, or water-soluble copolymers of these acids of their salts, esters or amides with each other or with one or more other ethylenically unsaturated monomers, such as, for example, styrene, maleic acid, maleic anhydride, 2-hydroxyethylacrylate, acrylonitrile, vinyl acetate, ethylene, propylene, and the like.

These homopolymers or copolymers are characterized by their high molecular weight, in the range of from about 500,000 to 10,000,000, preferably 500,000 to 5,000,000, especially from about 1,000,000 to 4,000,000, and by their water solubility, generally at least to an extent of up to about 5% by weight, or more, in water at 25° C.

These thickening agents are used in their lightly crosslinked form wherein the crosslinking may be accomplished by means known in the polymer arts, as by irradiation, or, preferably, by the incorporation into the monomer mixture to be polymerized of known chemical crosslinking monomeric agents, typically polyunsaturated (e.g. diethylenically unsaturated) monomers, such as, for example, divinylbenzene, divinylether of diethylene glycol, N,N'-methylene-bisacrylamide, polyalkenylpolyethers (such as described above), and the like. Typically, amounts of crosslinking agent to be incorporated in the final polymer may range from about 0.01 to about 1.5 percent, preferably from about 0.05 to about 1.2 percent, and especially, preferably from about 0.1 to about 0.9 percent, by weight of crosslinking agent to weight of total polymer. Generally, those skilled in the art will recognize that the degree of crosslinking should be sufficient to impart some coiling of the otherwise generally linear polymeric compound while maintaining the crosslinked polymer at least water dispersible and highly water-swellable in an ionic aqueous medium.

It is also understood that the water-swelling of the polymer which provides the desired thickening and viscous properties generally depends on one or two mechanisms, namely, conversion of the acid group containing polymers to the corresponding salts, e.g. sodium, generating negative charges along the polymer backbone, thereby causing the coiled molecules to expand and thicken the aqueous solution; or by formation of hydrogen bonds, for example, between the carboxyl groups of the polymer and hydroxyl donor. The former mechanism is especially important in the present invention, and therefore, the preferred polyacrylic acid-type thickening agents will contain free carboxylic acid (COOH) groups along the polymer backbone. Also, it will be understood that the degree of crosslinking should not be so high as to render the crosslinked polymer completely insoluble or non-dispersible in water or inhibit or prevent the uncoiling of the polymer molecules in the presence of the ionic aqueous system.

The present bathroom cleaning compositions are readily made by simple mixing methods from readily available components which, on storage, do not adversely affect the entire composition. The viscosity of the light duty liquid composition desirably will be at least water thin of about 5 centipoises (cps) at room temperature, but may be up to 200 centipoises as measured with a Brookfield Viscometer using a number 21 spindle rotating at 20 or 50 rpm. The pH of the composition is from about 9 to about 14, more preferably about 10 to about 13. The pH of the composition can be adjusted by the addition of $Na_2O$ (as caustic soda) to the composition.

DESCRIPTION OF THE PREFERRED EMBODIMENTS

Example 1

Soap Scum Removal Test

Several soap scum tests had been conducted with efficacy performance ranging from 80% to 98% versus the control, which is either a nonbleach product position to remove soap scum or an acidic product. A comparison of a bleach prototype products versus a number of control samples was made.

Test Procedure:

The laboratory method consists of soiling ceramic tiles with a synthetic soap scum stain by baking the stain on the tiles. The stain, which was sprayed evenly on the tiles consist of:

| | |
|---|---|
| Isopropanol | 135 grams |
| Calcium stearate | 9.18 grams |
| Magnesium stearate | 5.82 grams |
| Calco oil blue ZV dye | 0.1 gram |

The soap scum stain contains a blue dye to aid visual testing.

The Gardner Heavy Duty Tester WG6700 was used to simulate the scrubbing action on the tiles. The number of stroke which was constant across all the products being compared was established using a control product that provided 95% cleaning. There were five tiles being used per product. The degree of cleaning power was measured visually by 10 panelists. A replicate was always done.

Formula:

The prototype formulas in wt. % that were used are:

| | A (wt. %) | B (wt. %) | C (wt. %) |
|---|---|---|---|
| NaOCl | 3 | 3 | 1 |
| Amine oxide | 1.7 | 2.5 | 4.0 |
| Fatty acid | — | — | 0.7 |
| NaOH | 0.8 | 0.8 | 1.0 |
| Sodium silicate | 0.92 | 0.92 | 0.92 |
| Sodium tripolyphosphate anhydrous | 1.7 | 2.0 | 3.0 |
| Fruitate | 0.0001 | 0.0001 | 0.0001 |
| Foam control agent | 0.003 | 0.003 | 0.003 |
| Stabilizer | 0.0035 | 0.0035 | 0.0035 |
| Perfume | — | — | 0.28 |
| Softened water | to 100 | to 100 | to 100 |
| Viscosity, cps | water thin | water thin | 35 |

The tests results showed the following:

| | pH | Results |
|---|---|---|
| Shower power spray | 2.1 | 100 |
| Pine cleen multi purpose gel | 2.45 | 31 |
| Ajax bathroom gel | 3.15 | 85 |
| Ajax power gel | 6.6 | 34 |
| Formula A | 13.03 | 80 |
| Formula B | 13.10 | 94 |
| Formula C | 13.11 | 98 |

While Pine Cleen Multi Purpose Gel was acidic, surprisingly, it performed poorly in removing soap scum. The B and C formulas presented, even though they are alkaline with bleach, performed almost comparable to the control product which was acid base.

Formulas A, B and C were subjected to a stability test. After 12 weeks at RT and 40° C. conditions, the values obtained were acceptable.

Due to the high level of amine oxide in the formula C, foam test was conducted. The formula C and the control, Shower Power Spray, have comparable lather profile as shown:

| | Lather height, ml. | |
|---|---|---|
| | Prototype Formula | Shower Power Spray |
| Initial | 0 | 0 |
| After 1 min. | 18 | 16 |
| 3 mins. | 15 | 15 |
| 5 mins. | 12 | 13 |
| 10 mins. | 10 | 11 |

The cylinder inversion lather test was employed. This consists of measuring a 10 mls solution of the test product, placed it in a 2L cylinder and invert the capped cylinder for 10 full inversion cycles. The height of the foam generated is measured in ml. after 1, 3, 5 and 10 minutes. Replicate values are obtained and the average is computed.

What is claimed is:

1. A bathroom cleaning composition which comprises approximately by weight:

(a) 0.1% to 10% of a chlorine bleach compound;

(b) 0.5% to 5% of an amine oxide surfactant;

(c) 0.1% to 3% of an alkali metal silicate;

(d) 0.25% to 5% of a phosphate builder salt; and (e) the balance being water.

2. A bathroom cleaning composition according to claim 1 further including 0.1% to 1% of a fatty acid.

3. A bathroom cleaning composition according to claim 2 further including 0.05% to 3.0% of an alkali metal hydroxide.

4. A bathroom cleaning composition according to claim 3 further including 0.0001% to 0.1% of a silicone foam control agent.

5. A bathroom cleaning composition according to claim 4 further including 0.01% to 0.6% of a perfume.

6. A bathroom cleaning composition according to claim 5 further including ethyl tricyclo[5.2.1$^{25}$]decan-2-carboxylate.

7. A bathroom cleaning composition according to claim 1 further including 0.1% to 2.5% of a polymeric thickening agent.

8. A bathroom cleaning composition according to claim 1 further including a nonphosphate builder salt.

* * * * *